United States Patent [19]

Draft et al.

[11] Patent Number: 4,689,835

[45] Date of Patent: Sep. 1, 1987

[54] FACE GUARD DESIGN

[76] Inventors: Howard J. Draft, 1050 Helen La., Madison Heights, Mich. 48071; Robert W. Chambers, 3540 Greentree Rd., Bloomfield Hills, Mich. 48013

[21] Appl. No.: 317,498

[22] Filed: Nov. 2, 1981

[51] Int. Cl.[4] ..... A42B 3/00

[52] U.S. Cl. ..... 2/424; 2/9; 2/425

[58] Field of Search ..... 2/9, 10, 424, 425; 5/93; D2/233, 232

[56] References Cited

U.S. PATENT DOCUMENTS

| | | | |
|---|---|---|---|
| 3,283,336 | 11/1966 | Critser . | |
| 3,729,746 | 5/1973 | Humphrey . | |
| 3,815,152 | 6/1974 | Bednarczuk et al. . | |
| 3,897,598 | 8/1975 | Bednarczuk et al. . | |
| 4,086,664 | 5/1978 | Humphrey et al. . | |
| 4,594,737 | 6/1986 | Butash | 2/9 X |

*Primary Examiner*—Peter Nerbun

*Attorney, Agent, or Firm*—Harness, Dickey & Pierce

[57] ABSTRACT

A face guard for an athletic helmet having at least one horizontal bar structure with the bar structure including a plurality of rotatable elements to inhibit gripping the bar structure by hand.

10 Claims, 2 Drawing Figures

FACE GUARD DESIGN

BACKGROUND AND SUMMARY OF THE INVENTION

The present invention relates to face guards for athletic helmets and more particularly to face guards having a construction inhibiting gripping by hand.

Athletic helmets such as those used for football players are provided with a face guard to protect the face of the player from injury. Frequently, however, one player in order to stop an opponent will grab the face guard part of the helmet. This can result in severe and sometimes fatal injury to the player. In the present invention the face guard is provided with a horizontal bar structure which includes a plurality of rotatable, bead like elements. Thus when one player attempts to grip the bar structure there will be a tendency for the bead like elements to rotate in that players fingers, especially in a dynamic condition, whereby gripping is made more difficult. It should be understood that while the present invention will inhibit gripping it cannot assure that in all cases gripping will be prevented.

Therefore it is an objet of the present invention to provide a face guard for an athletic helmet which has a bar structure which includes a plurality of rotatable elements which inhibit gripping.

It is another general object of the present invention to provide a new and improved face guard.

Figure 1:
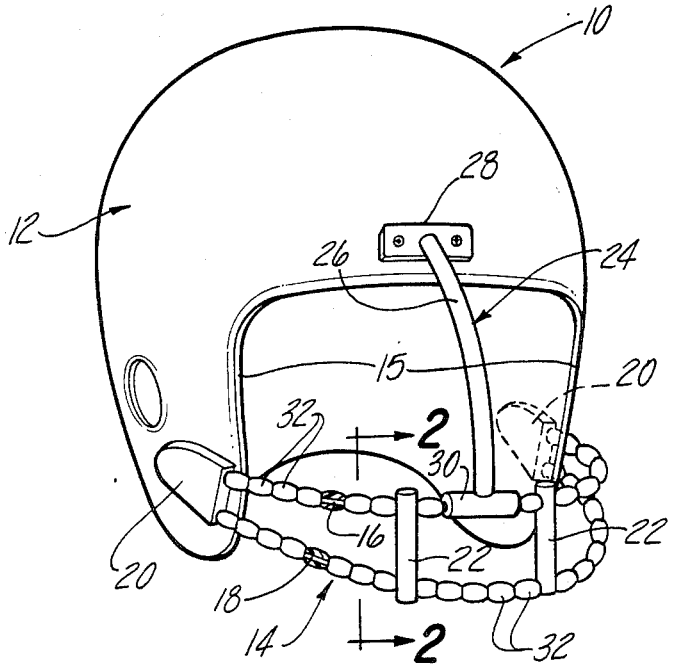
Figure 2:
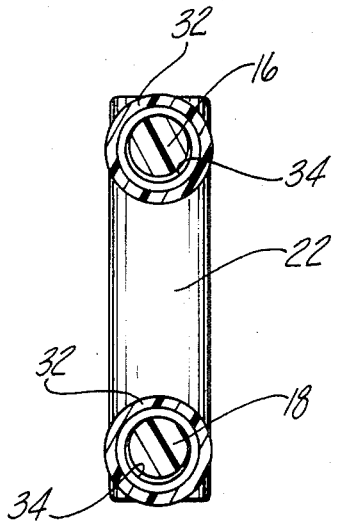

Other objects, features, and advantages of the present invention will become apparent from the subsequent description and the appended claims, taken in conjunction with the accompanying drawing, in which:

FIG. 1 is a pictorial view of an athletic helmet with the face guard of the present invention; and FIG. 2 is an enlarged sectional view of the face guard of FIG. 1 taken generally along the lines 2—2.

Looking now to the drawings an athletic helmet assembly 10 is shown to include a helmet 12 and a face guard assembly 14. The helmet 12 can be of a conventional football helmet construction and hence the details have been omitted for simplicity.

The face guard assembly 14 includes upper and lower bar members 16 and 18, respectively, which extend horizontally across the face opening 15 of helmet 12. The horizontal bar members 16 and 18 are vertically spaced and are secured at their opposite ends to retainer members 20 which in turn are secured to helmet 12. The bar members 16 and 18 are held apart by vertical support rods 22. The assembly 14 has a nose guard portion 24 which includes a curved but generally vertically extending rod portion 26 connected to an attachment block portion 28 at one end and a horizontally extending, tubular retainer portion 30. The block portion 28 is adapted to be secured to the upper portion of helmet 12 via suitable fasteners such as rivets or the like, while the retainer portion 30 is of a hollow structure and receives the upper bar member 16. Thus the nose guard portion 24 is secured between block portion 28 and retainer portion 30.

Each of the horizontal bar members 16 and 18 is provided with pluralities of identical elongated roller members 32. Each of the roller members 32 is tubular and has a central opening 34 adapted to receive the bar members 16 and 18 whereby each roller member 32 can freely and independently rotate on its associated bar member 16 and 18. Each of the roller members 32 has a generally elliptical outer shape whereby the diameter at the opposite ends is substantially less than that at the center. It is believed that this reduced diameter at the opposite ends minimizes end contact between adjacent rollers 32 thus permitting easier relative rotation between adjacent rollers 32. It is also believed that the elliptical shape of the rollers 32 by presenting a generally broken pattern or irregular shape across the face guard assembly 14 may make gripping more difficult than if the rollers 32 were shaped as straight cylinders.

In a preferred form the bars 16 and 18 are steel bars while the rollers 32 are made of a durable plastic material such as an acetal resin. The acetal resin has good lubricity characteristics whereby rolling on the bars is facilitated.

Thus with the construction as shown and described the relatively free rolling action of rollers 32 will inhibit the gripping of the face guard assembly 14 especially under the dynamic conditions of play when the players are moving relatively to each other.

In the embodiment shown in FIGS. 1 and 2 rollers 32 are used only on the horizontal bars 16 and 18; it should be understood that a similar roller structure could be used elsewhere, for example on the nose guard portion 24.

It should also be understood that the face guard assembly 14 could take various shapes with bars and rollers oriented at different locations.

While it will be apparent that the preferred embodiment of the invention disclosed are well calculated to fulfill the objects above stated, it will be appreciated that the invention is susceptible to modification, variation and change without departing from the proper scope or fair meaning of the invention.

What is claimed is:

1. In an athletic helmet having a face opening and a face guard assembly located across the face opening, said face guard assembly comprising: at least one bar member extending generally across the face opening and a plurality of rollers rotatably supported on said bar member whereby manual gripping of the face guard assembly is inhibited, at least two of said rollers being located adjacent each other on said bar member with no intervening non-rotatable element in between.

2. The invention of claim 1 with said rollers being generally cylindrical and having a generally elliptical outer shape.

3. The invention of claim 2 with each of said rollers being substantially identical.

4. The invention of claim 2 with said bar member extending horizontally across the face opening.

5. In an athletic helmet having a face opeining and a face guard assembly located across the face opening said face guard assembly comprising: a pair of vertically spaced bar members extending horizontally across the face opening, and a plurality of cylindrical rollers rotatably supported on said bar members whereby manual gripping of the face guard assembly is inhibited, at least two of said rollers being located adjacent each other on each of said bar members with no intervening non-rotatable elements in between.

6. The face guard assembly of claim 5 further comprising a vertically extending nose guard portion secured between the helmet and at least one of said bar members.

7. The invention of claim 5 with said rollers being generally cylindrical and having a generally elliptical outer shape.

8. The invention of claim 7 with each of said rollers being substantially identical.

9. The invention of claim 1 with said rollers being made of a material having good lubricity characteristics.

10. The invention of claim 1 with said rollers being made of a material such as an acetal resin having good lubricity characteristics.

* * * * *